US005095245A

United States Patent [19]

Waymouth

[11] Patent Number: 5,095,245

[45] Date of Patent: Mar. 10, 1992

[54] ELECTROLUMINESCENT DEVICE

[75] Inventor: John F. Waymouth, Marblehead, Mass.

[73] Assignee: John F. Waymouth Intellectual Property and Education Trust, Marblehead, Mass.

[21] Appl. No.: 465,317

[22] Filed: Jan. 16, 1990

Related U.S. Application Data

[63] Continuation of Ser. No. 236,492, Aug. 25, 1988, abandoned.

[51] Int. Cl.[5] ..... H01J 63/04

[52] U.S. Cl. ..... 313/509; 313/506; 313/483

[58] Field of Search ..... 313/495, 509, 500, 501, 313/505, 506, 483, 484, 643

[56] References Cited

U.S. PATENT DOCUMENTS 2,855,531 10/1958 Nicoll ..... 313/484

3,030,540 4/1962 Mash ..... 313/509

4,369,393 1/1983 frx ..... 313/509

*Primary Examiner*—Donald J. Yusko

*Assistant Examiner*—Michael Horabik

*Attorney, Agent, or Firm*—Edward A. Gordon

[57] ABSTRACT

The EL device includes a first electrode which is a transparent electrically conducting layer, a dielectric layer overlying the first electrode and a plurality of electroluminescent block members disposed in spaced relationship on the dielectric layer, each EL block member having a first surface disposed in contact with the dielectric layer and a distal second surface. A second or counter electrode which is formed of an electrically conductive layer is positioned in spaced relationship to the distal second surfaces of the electroluminescent block members. The dimensions of the electroluminescent block provide for preselected sonic isolation so as to provide for reduction of phonon waves of varying energies and increase the output brightness of the device.

14 Claims, 4 Drawing Sheets

ELECTROLUMINESCENT DEVICE

BACKGROUND OF THE INVENTION

1. Field Of The Invention

The present invention relates to a electroluminescent (sometimes referred to as "EL" hereinafter) device and, more particularly, to such a device having improved light output and a method of making the device.

2. Description Of Prior Art

Electroluminescent devices, whether for a light source, indicator lamp, or display applications have been known for many years. In such EL devices, electroluminescent materials are directly electrically excited to luminescence by the application of time varying electric fields to a volume containing electroluminescent phosphors contained between two electrodes, at least one of which is transparent.

Electroluminescent lamps are known principally in one or the other of two preferred embodiments. In the first, the so called "thick film" or "powder" EL, the electroluminescent material consists of a crystalline fine powder of activated electroluminescent phosphors such as zinc sulphide, cadmium sulphide, cadmium selenide, gallium phosphide, gallium arsenide and the like activated with copper, silver, manganese or others, dispersed in an insulating matrix which is disposed between a transparent conductor and a counter electrode.

The other principal type of electroluminescent lamp is the "thin film" EL, in which the electroluminescent material, again commonly activated EL phosphor compound, is vapor deposited in a thin film, sandwiched between two layers of similarly vapor deposited insulating material, with the entire assembly disposed between a transparent conductor and a counter electrode.

Regardless of the embodiment, EL lamps exhibit a strongly rising output of light with applied voltage and a nearly linear increase in output of light with increasing frequency. The output of light is very inefficient, however, being limited to a few lumens per watt in either embodiment. This low efficiency has prevented the widespread use of EL in any applications except for indicator or display devices.

It is widely accepted that this low efficiency stems from the fundamental physical phenomena occurring in these lamps, as follows: In the electroluminescence of such crystals as zinc sulfide, electrons liberated from deep traps or injected from contact electrodes or p-n junctions are accelerated by the electric field until they acquire sufficient kinetic energy to excite or ionize a luminescent center which subsequently radiates with the emission of light. A competing energy loss mechanism for the electrons is the loss of kinetic energy from elastic collisions between electrons and lattice atoms. Unlike the situation in a gas discharge, however, where electrons collide with isolated atoms unbound to others, the target atoms in a solid are bound by very strong elastic bonds to neighboring atoms. As a consequence, the target atom cannot move by itself upon impact, but must transmit some of this motion to adjacent atoms, which in turn transmit such motion to their neighbors, which in turn transmit such motion to their neighbors, etc, ad infinitum. Thus, the impact of an electron on a lattice atom, generates a sound wave travelling through the lattice. Such sound waves on the atomic scale are quantized, with energy in the wave packet $=h\nu$ where $\nu$ is frequency and h is Planck's constant $6.61\times10^{-34}$ joule-sec. These quanta are called "phonons" by analogy with the photons of the optical spectra. The elastic collision of electrons with the lattice is therefore a collision with the phonon wave trains, and the interchange of electron energy with the phonon field is in units of the phonon energy. The problem is that in the usual electroluminescent solid of large spatial extent, the spectrum of lattice phonon waves is a very wide 1/f distribution (phonons per unit frequency interval vary inversely with frequency) in the manner of the solid curve in FIG. 1A. Thus there is a very large number of low energy phonon waves to which the electron may couple, losing small amounts of energy per collision, but with very frequent collisions of large cumulative energy loss. This large cumulative energy loss exerts a very large "drag" on the acceleration of electrons by the electric field. Moreover, the "cross-section" for collision with phonon waves varies approximately inversely with electron velocity, as in FIG. 1B. Accordingly, electrons at low energy, have a very large probability of losing energy to the plenitude of low energy phonon waves, which prevents them from gaining energy from the electric field to reach the energy range of reduced cross-section for collision, beyond which they experience reduced elastic collision loss and may be accelerated to energies capable of exciting or ionizing luminescent centers.

Consequently, as shown in FIG. 1C, the distribution of electron energies is strongly skewed to low energy electrons, even at high electric fields. Thus most of the electrons are unable to excite or ionize luminescent centers, but can only dissipate energy in phonon collisions that ultimately produce nothing more than heat. As a result, efficiency of electroluminescence is low, with efficacies of 1–10 lumens per watt, useful only for indicator or display devices.

Accordingly, a desirable object of the present invention is to provide an improved EL device and method of making the same.

Another desirable object of the present invention is to provide an EL device having higher efficiency and improved light output.

A still further desirable object of the present invention is to provide a thin or thick film EL layer structure which reduces energy losses of electrons in collision with the phonon waves of the lattice atoms, thereby increasing the fraction of the electron energy gained from the electric field dissipated in the useful excitation collisions with luminescent centers.

A still further desirable object of the invention is to accomplish the foregoing object by the substantial reduction or elimination of low frequency, long wavelength phonon waves with low phonon energy, to which low energy electrons may lose small amounts of energy per collision in very frequent collisions.

These and other desirable objects of the invention will in part appear hereinafter and will in part become apparent after consideration of the specification with reference to the accompanying drawings and the claims.

SUMMARY OF THE INVENTION

Briefly described, in accordance with the present invention, the EL device includes a first electrode which is a transparent electrically conducting layer, a dielectric layer overlying the first electrode and a plurality of electroluminescent block members disposed in spaced relationship in a two dimensional array, each EL block member having a first surface on the dielectric layer and a distal second surface. A second electrode (counter electrode) which is an electrically conductive layer is positioned in spaced relationship to the distal second surfaces of the electroluminescent block members.

In another embodiment of the invention, the dielectric layer contacting the first surface of each EL block member is undercut to lessen the area of surface contact between the EL block members and the dielectric layer.

In still another embodiment of the invention, the distal second surfaces of the EL block members are provided with dielectric cap layers.

The invention is also a method of fabricating the EL device which includes the steps of depositing a layer of the EL material on a layer of dielectric material overlying a first electrode which is a transparent electrically conductive layer, by chemical vapor deposition, segmenting the deposited layer of EL material into a plurality of acoustically isolated spaced block members and forming a second electrode comprising an electrically conductive layer in spaced relationship to the EL block members and the dielectric layer.

BRIEF DESCRIPTION OF THE DRAWINGS

For a fuller understanding of the nature and desired objects of the present invention, reference should be made to the following detailed description taken in conjunction with the accompanying drawings wherein like reference characters denote corresponding parts throughout several views and wherein.

DETAILED DESCRIPTION OF PREFERRED EMBODIMENT(S)

Figure 3A:
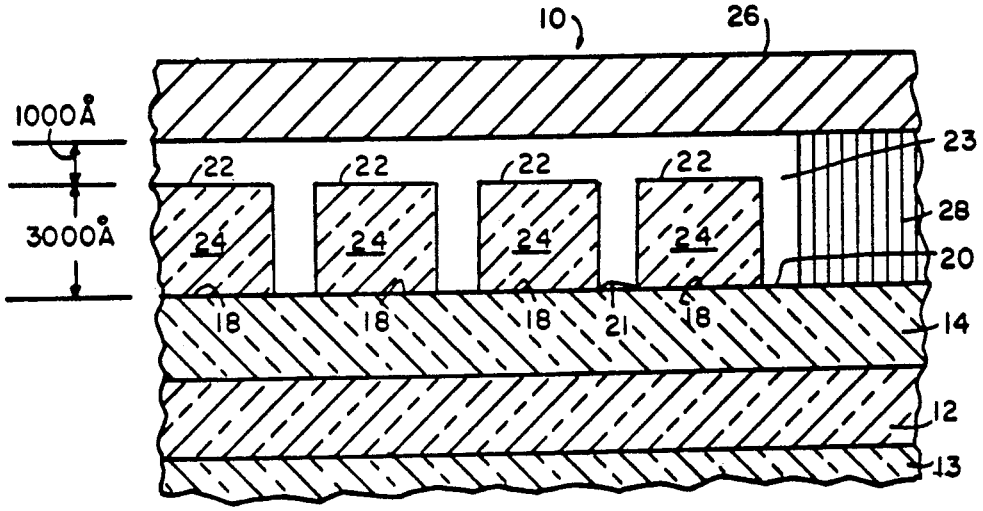
FIG. 3A is a fragmentary cross-sectional view of a thin film EL device structure embodying the principles of the present invention.
Figure 3B:
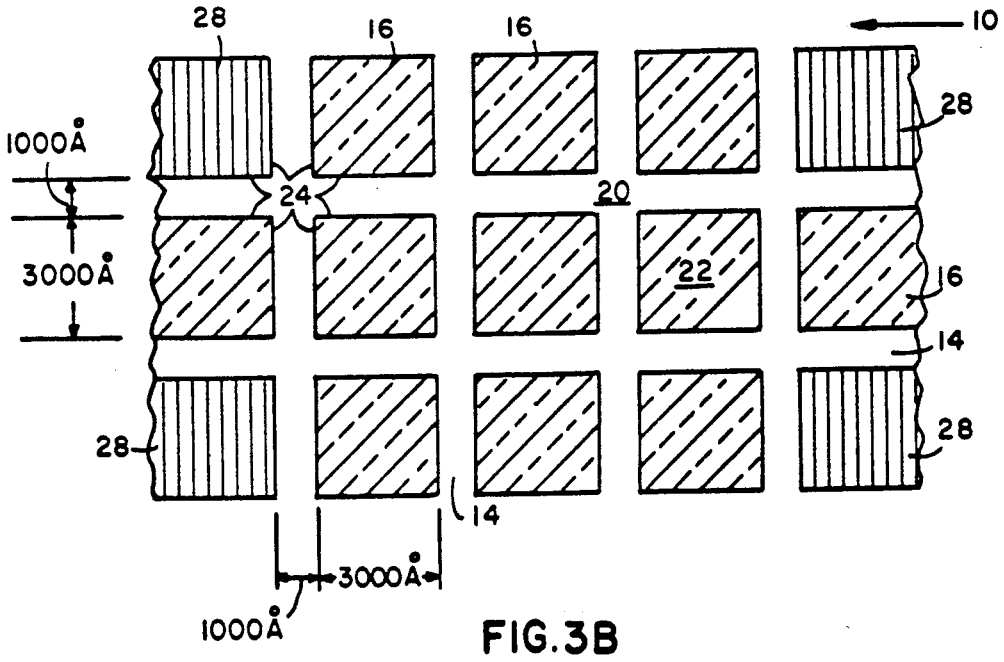
FIG. 3B is a top sectional view of an EL device similar to FIG. 3A with the counter electrode layer 26 removed to illustrate the preferred spacing of the EL block members 16.

Referring now to the drawings and more particularly to FIGS. 3A and 3B, there is illustrated an EL device embodying the principles of the present invention. The EL structure comprises a transparent electrically conductive layer 12, which serves as a first or front electrode. The first electrode layer 12 may be formed of indium oxide ($In_2O_3$), tin oxide ($SnO_2$), Indiun tin oxide or the like with a thickness of about 2000 angstroms (Å) applied to a transparent substrate 13 such as glass, for example. A dielectric layer 14 overlies the first electrode layer 12. The dielectric layer 14 is made of transparent insulating material in order to transmit light emitted by the electric luminescent EL block members 16. The dielectric layer may be composed of any substantially transparent, electrically insulating material having a high dielectric constant and breakdown voltage and is preferably composed of inorganic materials. The dielectric layer may be a composite of more than one layer. Suitable materials include aluminum oxide or silicon nitride deposited by sputtering or evaporation or, for example, yttrium oxide deposited at a temperature of about 450° C. by chemical vapor deposition. The dielectric layer 14 may have a thickness of about 1000 to 5000 Å. Disposed in spaced relationship in a two dimensional array upon the dielectric layer 14 are a plurality of EL block members 16 each having a first surface 18 overlying the surface 20 of the dielectric layer 14 and a second or distal surface 22. The EL block members 16 may be formed of electroluminescent phosphor materials such as zinc sulfide (ZnS) which may contain manganese (Mn), or any of the electroluminescent phosphors known to the prior art of thin film EL devices. The size of the EL blocks 16 are illustrated as being 3000 Å square blocks having a thickness of 3000 Å thereby forming a 3000 Å cubic structure. The side walls 24 of each EL block are spaced from each other by a distance about 1000 Å. The lateral spacing between blocks in the two dimensional array is not critical to the achievement of the object of the invention. However, it is to be understood that advantage is gained by making it as small as feasible to increase the fraction of the volume occupied by EL phosphor blocks capable of producing light. A second or back electrode 26, which serves as a counter electrode, is formed of an electrically conductive layer of material such as aluminum having a thickness of about 2000 Å. The second electrode 26 may be formed by vapor deposition of aluminum upon a substrate or formed as a solid metal sheet of aluminum or other conductive metal. The second electrode layer 26 which is illustrated as a metal sheet and its substrate (not shown) where such is included is positioned in spaced relationship from distal second surfaces 22 of the EL block members by spacer block members 28.

The EL block members 16 are formed by first vacuum vapor depositing a layer of a phosphor material such as ZnS on the dielectric layer 14 to provide an EL layer having a thickness of, for example, 3000 Å. The EL layer film is then etched to segment the EL film layer into a plurality of the cubic EL block members 16. The etching can be carried out by defining the EL blocks photolithographically and etching with an acid such as hydrochloric acid. Alternatively reactive sputter or etching or other conventional semiconductor processing techniques may be used for selective removal of material to form the spaces between blocks. The EL block member 16 and the portions 21 of the dielectric layer surface 20 not covered by the EL blocks 16 are surrounded by the space area 23 which is formed as a vacuum space or provided with a dry inert gas such as argon or nitrogen to enhance the isolation of the EL blocks as well as prevent contact of the distal surfaces 22 with the counter electrode 26. This structure will require close control of spacing of the counter electrode 26 which, as illustrated, is provided by the spacer blocks 28 which are disbursed in numbers in a small ratio to the number of EL blocks, for example, about one per hundred of EL blocks 16. Where the EL blocks 16 have a thickness of 3000 Å the insulating spacers 28 are provided with a thicker or higher structure such as 3500–4000 Å. Thus, in the EL device 10 illustrated in FIGS. 3A and 3B, the second insulating layer commonly employed in prior art EL devices is replaced by a vacuum space or inert dry gas medium. Because of the low dielectric constant of this medium in comparison to the EL layer or to the remaining dielectric layer 14, the thickness of the vacuum or inert gas space between the distal surfaces 22 and the counter electrode 26 should be kept as small as possible but consistent with uniformity of thickness, to minimize the fraction of the applied potential that appears across it when a conventional power source (not shown) is activated.

The spacer block members 28 can be formed from the dielectric layer 14. For example, the dielectric layer 14 can be vapor deposited upon the transparent conductor layer 12 to form a layer having a thickness of 6000 Å. The dielectric layer 14 is then etched down to a thickness of 2000 Å except for areas defining the spacer members. The spacer members 28 are then masked and EL layer is then vapor deposited upon the open area of the dielectric layer 14 to form an EL layer having a thickness of 3000 Å which is lower by 1000 Å than the spacer members 28. The EL layer is then etched as discussed to form a plurality of EL block members 16. Thereafter the counter electrode 26 is attached to the spacer members 28.

In an alternate method, the EL block members 16 are masked so that only the distal surfaces 22 of Preselected block members 16 are exposed. A perforated mask member can be used. The exposed distal surfaces 20 of the selected block members 16 are then coated with a layer of dielectric material 32 having a thickness of 500–1000 Å (as discussed hereinafter with respect to FIG. 5) to thereby form spacer members upon which the counter electrode 26 is attached.

In accordance with the present invention, the spacing of the EL block members 16 from each other as well as the counter electrode 26 provides for acoustically isolated EL block members. A novel feature of the EL structure is that the permissible phonon wavelengths and frequencies are limited. In accordance with the EL structure illustrated in FIGS. 3A and 3B, the phonon waves of wavelength longer than 6000 Å can no longer exist therein, because multiple reflection from the walls 24 of the solid EL blocks 16 produce a random distribution of phases of vibrations of atoms within the EL cube-shaped block member 16 that average to zero. Consequently, the longest wavelength and lowest frequency phonon that can exist within the acoustically isolated solid EL blocks 16 is the one for which the dimensions of the solid equal one-half the wavelength. Assuming a sonic velocity of 5000 m/sec, this sets a lower limit to the phonon frequency of $8.33\times10^9$ hz.

Figure 1A:
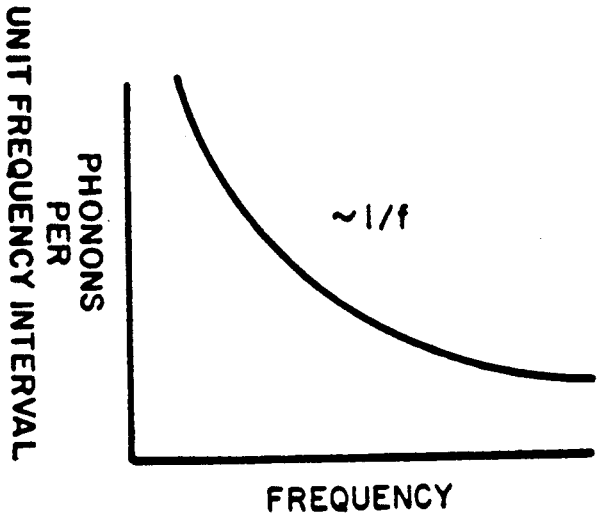
FIG. 1A is a graph showing schematically the distribution of phonons per unit frequenoy interval as a function of the frequency of said phonons, as related to prior art EL structures.
Figure 1B:
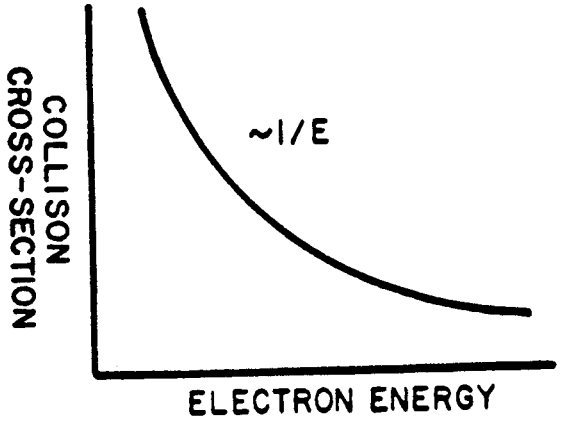
FIG. 1B is a graph showing schematically the cross-section for collision with phonon waves as an inverse function of electron energy (velocity) as related to prior art EL structures.
Figure 1C:
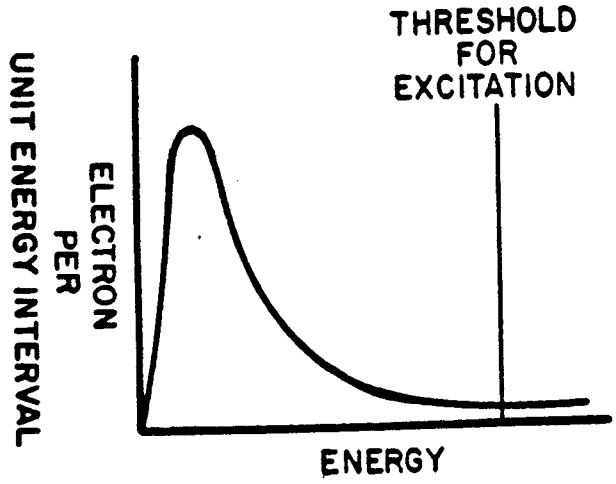
FIG. 1C is a graph showing schematically the fraction of the electrons per unit energy interval as a function of electron energy as related to prior art EL structures.
Figure 2A:
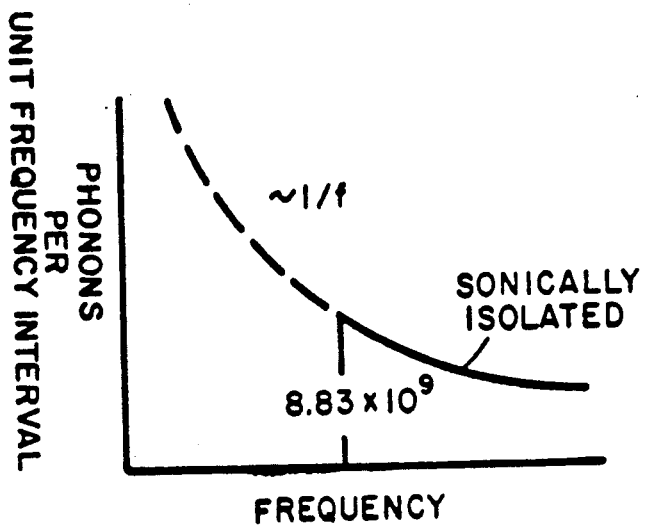
FIG. 2A is a graph showing schematically the distribution of phonons per unit frequency interval as a function of the frequency of said phonons in accordance with the EL structure of the present invention.
Figure 2B:
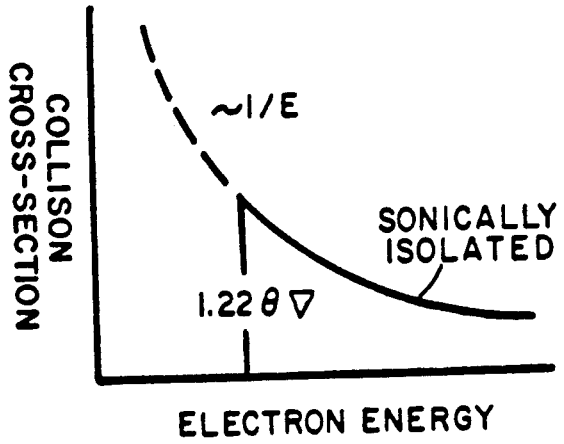
FIG. 2B is a graph showing schematically the cross-section for collision with phonon waves as an inverse function of electron energy (velocity) in accordance with the EL structure of the present invention.

As shown in FIG. 2A, this eliminates a large majority of the low frequency phonons to which the electrons can lose energy, thereby permitting electrons to be accelerated much more easily to velocities at which the cross-section for phonon collisions drop to much lower levels. The lowest phonon energy ($h\nu/e$, where e is the electron charge and h is Planck's constant) is then $3.65\times10^{-5}$ ev. The maximum fraction of the electron energy that the electron can lose in a collision with a lattice atom is about 8/3(m/M) where m is electron mass and M is lattice atom mass. Therefore, the lowest energy electron in ZnS that can lose $3.65\times10^{-5}$ev to a phonon is 1.22 ev. Since there are no phonon waves of frequency $<8.33\times10^9$ hz, the cross-section for elastic collision loss with phonon waves for electrons in the lattice is therefore truncated at 1.22 ev, and is zero below that energy, as in FIG. 2B.

Figure 2C:
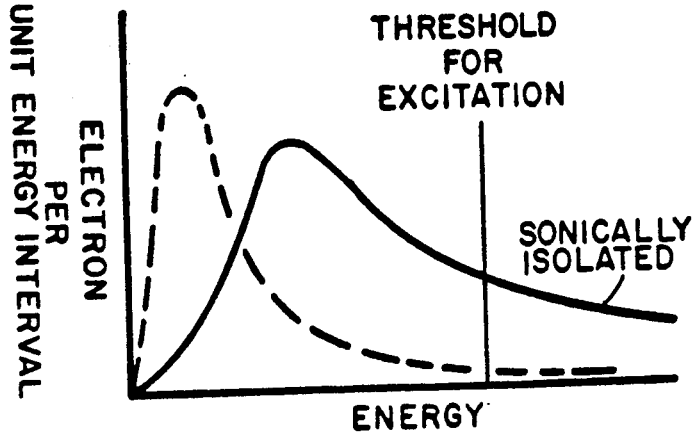
FIG. 2C is a graph showing schematically the fraction of electrons per unit energy interval as a function of electron energy in accordance with the EL structure of the present invention.

Consequently, in contrast to prior art EL devices, the electrons being accelerated by the field in the sonically isolated cubes of the EL device structure according to the present invention cannot lose energy in elastic collisions until they reach an energy of 1.22 ev, for which energy the cross-section for such collisions has already been greatly reduced. Accordingly, as provided by the EL device of the present invention, the resulting electron energy distribution is correspondingly shifted toward higher energies, as shown in FIG. 2C, with a much greater fraction of the electrons able to ionize and excite luminescent centers. The partition of energy dissipation between excitation and heat is therefore dramatically shifted toward excitation.

Figure 4:
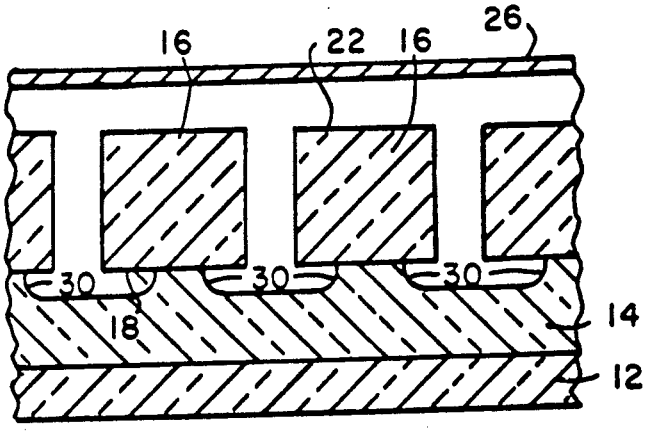
FIG. 4 is a fragmentary cross-sectional view of another embodiment of the EL structure in accordance with the present invention.

Referring now to FIG. 4, there is illustrated another embodiment of the invention. As shown the section of the dielectric layer 14 underlying the surface 18 of the EL block 16 is undercut as indicated at 30 to reduce the area of contact of the dielectric layer 14 with the overlying surface 18 of each EL block member 16. The undercutting feature provides for increased sonic isolation provided by the EL block members 16.

Figure 5:
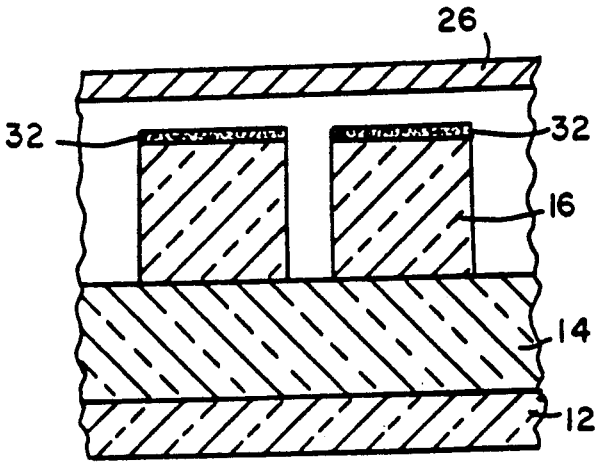
FIG. 5 is a fragmentary cross-sectional view of a still further embodiment of the EL structure in accordance with the present invention.

Referring now to FIG. 5, there is illustrated a still further embodiment of the present invention wherein the top surface 22 of each EL block member 16 is provided with an overlying layer or cap 32 of dielectric material to provide a symmetrical interface structure at each end surface 18 and 22 of the EL block members 16.

It should be understood that the selection of 3000 Å for the dimension of the sonically isolated volume of the EL block members 16 was to illustrate an example and that the dimensions of the EL block members can be varied. Similarly the thickness of the electrodes and dielectric layer can be varied within the scope of the invention. Additionally the EL block member 16 can be formed in other parallelepiped geometric shapes other than cubic (as illustrated) such as squares, rectangles and the like. Also they may be larger in width than 3000 Å. It is also to be understood that the larger the width of the EL blocks the lower will be the frequency of the lowest allowed mode phonon, and the greater will be the elastic energy losses of electrons thereto. Nevertheless, even though they might be as large as one micron (with $2.5\times10^9$hz the lowest phonon frequency, and 0.366 ev the lowest energy electron that can make elastic collisions with phonon waves), such a segmentation in accordance with the present invention will still provide significant advantage in efficiency over prior art EL devices.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. An electroluminescent device comprising:
a first electrode;
a dielectric layer overlying the first electrode;
a plurality of sonically-isolated electroluminescent block members disposed in spaced relationship on the dielectric layer, each electroluminescent block member having a first surface disposed in contact with the dielectric layer and a distal second surface; and
a second electrode positioned in spaced relationship to the distal second surfaces of said electroluminescent block members.

2. The electroluminescent device according to claim 1 wherein the first electrode in contact with the dielectric layer is disposed upon a substrate for supporting the electroluminescent device.

3. The electroluminescent device according to claim 1 wherein the second electrode is held in spaced relationship from the electroluminescent block members by a plurality of dielectric spacer block members.

4. The electroluminescent device according to claim 3 wherein the relative thickness of the dielectric spacer block members is greater than the thickness of the electroluminescent block members.

5. An electroluminescent device comprising:
a first electrode comprising a transparent electrically conductive layer;
a transparent dielectric layer overlying the first electrode;
a plurality of sonically-isolated electroluminescent block members disposed in spaced relationship on said dielectric layer;
said electroluminescent block members each having a first surface disposed in contact with said dielectric layer and a distal second surface; and
a second electrode comprising an electrically conductive layer positioned in spaced relationship to the distal second surfaces of said electroluminescent block members and the transparent dielectric layer by a plurality of dielectric spacer block members.

6. The electroluminescent device according to claim 5 wherein the first electrode in contact with the dielectric layer is disposed upon a transparent substrate for supporting the electroluminescent device.

7. The electroluminescent device according to claim 5 wherein the dielectric layer, electroluminescent block members, dielectric spacer block members and second electrode layer are enclosed in a fluid tight chamber.

8. The electroluminescent device according to claim 7 wherein the fluid tight chamber contains a vacuum.

9. The electroluminescent device according to claim 7 wherein the fluid tight chamber contains an inert gas.

10. The electroluminescent device according to claim 5 wherein the dimensions of the electroluminescent block members sets a limit to low-frequency phonons whereby electron energy loss is reduced.

11. The electroluminescent device according to claim 5 wherein the largest dimension of the electroluminescent block members is equal to one-half the wavelength of the lowest frequency phonon.

12. The electroluminescent device according to claim 5 wherein the dimensions of the electroluminescent block members provides a cross-section whereby the elastic collision loss with phonon waves for electrons in the lattice is truncated to zero below a pre-selected energy value.

13. The electroluminescent device according to claim 5 further including a coating of dielectric material disposed upon the distal surfaces of the electroluminescent block members.

14. An electroluminescent device comprising:
a first electrode comprising a transparent electrically conductive layer;
a transparent dielectric layer overlying said first electrode;
electroluminescent means providing for the reduction of electron collisions with phonon waves of lattice atoms when subjected to an electric field,
whereby the energy loss by electrons to collision with phonon waves of lattice atoms is reduced and the fraction of
electron energy dissipation in excitation collisions of electrons with luminescent centers is increased;
said electroluminescent means comprising a plurality of electroluminescent block members disposed in spaced relationship on said dielectric layer, each electroluminescent block member having a first wall surface disposed in contact with said dielectric layer, a distal wall surface and side walls;
said electroluminescent block members having dimensions for preselected sonic isolation providing for reduction of phonon waves of varying energies; and
a counter electrode formed of an electrically conductive layer positioned in spaced relationship to the distal second surfaces of said electroluminescent block members and the transparent dielectric layer.

* * * * *